United States Patent [19]

Spamer

[11] 4,401,223

[45] Aug. 30, 1983

[54] PITCH ADAPTER UNIT FOR DISPLAY DEVICES

[75] Inventor: William S. Spamer, Roswell, Ga.

[73] Assignee: The Mead Corporation, Dayton, Ohio

[21] Appl. No.: 326,815

[22] Filed: Dec. 2, 1981

[51] Int. Cl.[3] ..... A47F 5/00

[52] U.S. Cl. ..... 211/134; 108/1; 108/6

[58] Field of Search ..... 211/134; 108/1, 6, 108; 248/242; 52/730

[56] References Cited

U.S. PATENT DOCUMENTS

| | | | |
|---|---|---|---|
| 3,083,794 | 4/1963 | Stovall, Jr. | 52/730 X |
| 3,229,822 | 1/1966 | Janus | 211/134 |
| 3,817,005 | 6/1974 | Rannefeld | 52/730 X |
| 4,148,263 | 4/1979 | Suttles | 108/1 |
| 4,332,204 | 6/1982 | Hewell | 108/1 |

*Primary Examiner*—J. Franklin Foss
*Assistant Examiner*—Peter A. Aschenbrenner
*Attorney, Agent, or Firm*—Rodgers & Rodgers

[57] ABSTRACT

For supporting the base shelves of adjacent display devices at different angles of tilt, a pitch adapter is provided and comprises a pair of upright pitch adapter plates having top edges which are angularly inclined, vertically disposed center plate means interposed between the pitch adapter plates and secured thereto so that the top edges of said adapter plates are inclined in opposite directions and the upper edge of said center plate means inclined downwardly from each end thereof to a lower level between the ends thereof whereby the top edge of each end of said center plate means coincides approximately with the top edge of one end of different ones of said adapter plates.

10 Claims, 5 Drawing Figures

PITCH ADAPTER UNIT FOR DISPLAY DEVICES

TECHNICAL FIELD

This invention relates to display devices such as gondolas of the type commonly used in supermarkets and is for the purpose of supporting the base shelves of adjacent display units of different angles of tilt.

BACKGROUND ART

U.S. Pat. No. 3,601,256 issued Aug. 24, 1971 and owned by the assignee of this invention discloses a display stand having a base, a back, and a plurality of shelves secured in vertically spaced relation to the back and is provided with a base shelf which tilts rearwardly somewhat.

U.S. Pat. appln. Ser. No. 98,876 filed Nov. 30, 1979, now U.S. Pat. No. 4,314,698, discloses a display stand having a base and a back together with a plurality of downwardly tilted gravity feed shelves mounted in spaced relation on the back.

While it is common practice in supermarket outlets to arrange one or more display gondola units adjacent each other in side by side relation there has heretofore been no arrangement for supporting the base shelves of adjacent gondola units at different angles of tilt.

DISCLOSURE OF INVENTION

According to this invention in one form a pitch adapter unit is provided for supporting the base shelves of adjacent display devices at different angles of tilt and comprises a pair of upright pitch adapter plates having top edges which are angularly inclined, center plate means interposed between said pitch adapter plates and secured thereto in flat face contacting relation, the top edges of the adapter plates being inclined in opposite directions and the upper edge of said center plate means being inclined downwardly from each end thereof to a lower level between the ends thereof whereby the top edge of each end of said center plate means coincides approximately with the top edge of one end of different ones of said adapter plates. A base shelf which engages and is supported by the top edge of one adapter plate is disposed at a different angle of tilt than the base shelf of an adjacent display device since the edge of such shelf engages and is supported by the other pitch adapter plate.

BEST MODE OF CARRYING OUT THE INVENTION

Figure 1:
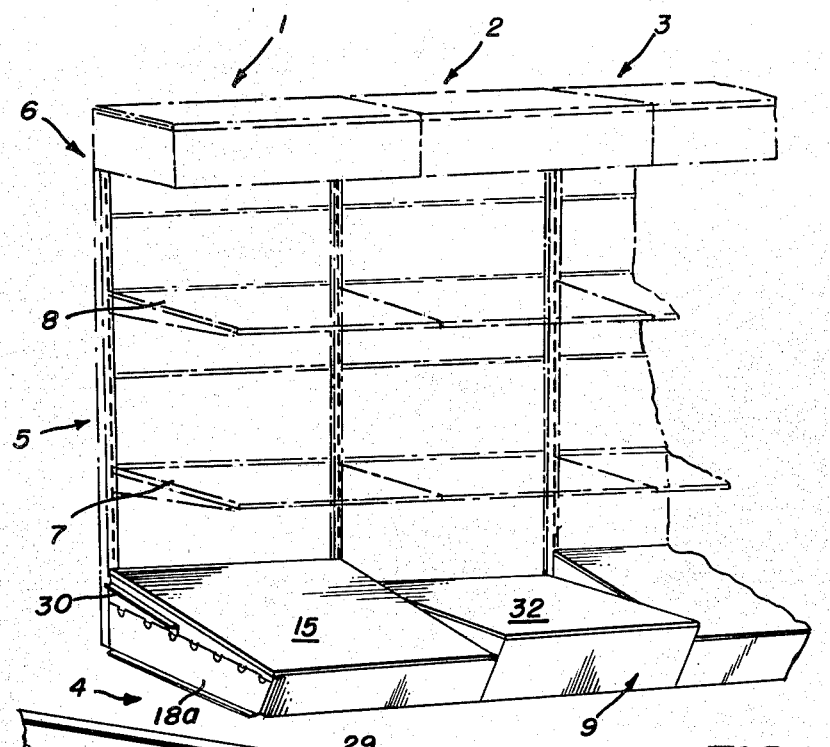
FIG. 1 is a perspective view of a plurality of side by side display gondola units having base shelves disposed at different angles of tilt.

In the drawings the numerals 1 and 2 generally designate display units mounted adjacent each other in side by side relation and the numeral 3 designates a third unit shown in fragmentary form. Display device 1 comprises a base structure generally designated by the numeral 4 together with a back portion generally designated by the numeral 5; a header structure 6 is mounted atop the back 5 and customarily includes advertising panels. Secured to the back 5 are shelves 7 and 8. Components of display devices 2 and 3 are identical to the components of display device 1 except the base structure 9 of display device 2 is formed differently in accordance with a major aspect of this invention.

Base 4 as is apparent from FIG. 1 is inclined forwardly and ordinarily could be used as a gravity feed device having parallel side by side low friction channels formed according to the aforementioned U.S. appln. Ser. No. 98,876, now U.S. Pat. No. 4,314,698, and of course would be provided with a front bumper for arresting the downward movement of displayed items mounted in the low friction channels such as 32 oz. and 64 oz. sizes of soft drink bottles arranged with one row of bottles in each channel so that the front bottle is in engagement with a front bumper according to U.S. appln. Ser. No. 98,876, now U.S. Pat. No. 4,314,698. Removal of the front bottle by the customer allows the bottles disposed behind the front bottles to slide forwardly to within easy reach of a succeeding customer. Base 9 on the other hand as is apparent from FIG. 1 is tilted rearwardly somewhat so as to afford a convenient and mechanically stable display for packaged items such as basket style bottle carriers and the like. Thus by the invention two different angles of tilt are provided and a pleasing variety to the overall display is achieved in accordance with one facet of this invention.

Figure 2:
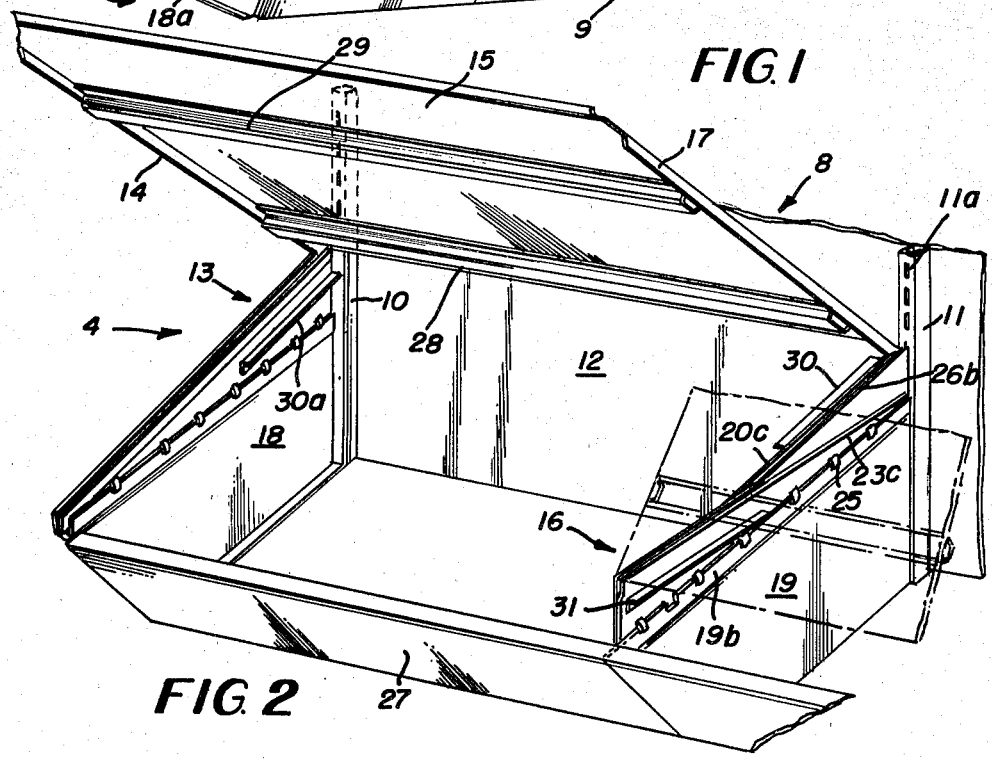
FIG. 2 is an enlarged perspective view of the base of one unit with the base shelf shown in an upwardly hinged position to reveal the adapter structure formed according to this invention.

Base structure 4 as shown in FIG. 2 includes the lower portion of the back structure 8 which includes upright posts 10 and 11 and back plate 12 which is secured to posts 10 and 11. Pitch adapter unit generally indicated at 13 supports the flanged edge 14 of base shelf 15 while pitch adapter structure generally designated at 16 engages and supports flanged edge 17 of base shelf 15. Pitch adapter unit 13 is sandwiched between an inner shoe plate 18 and an outer shoe plate **18*a* not observable in FIG. 2 but which is shown in FIG. 1. Pitch adapter unit 16 is sandwiched between an outer shoe plate 19 and an inner shoe plate not observable in FIG. 2 but which is shown in FIG. 4**.

Figure 3:
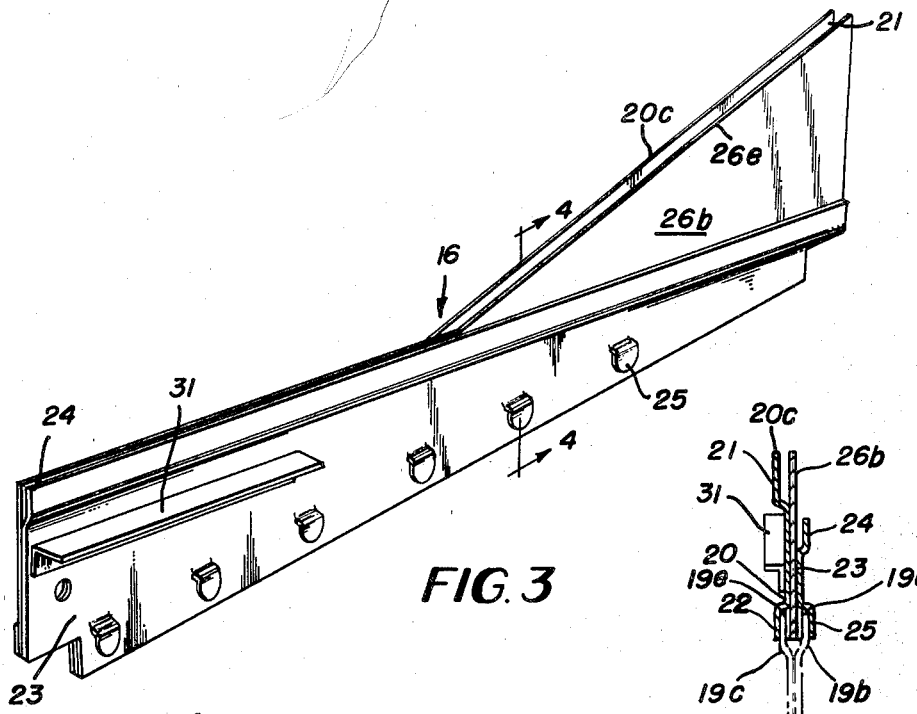
FIG. 3 is an enlarged perspective view of a pitch adapter unit formed according to this invention and which is shown with the components in assembled condition.
Figure 4:
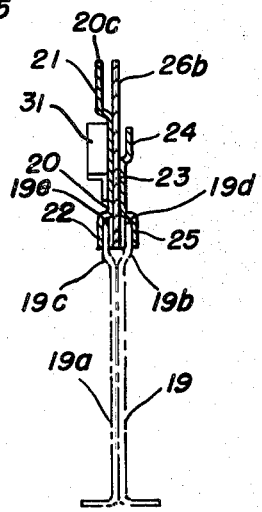
FIG. 4 is a cross sectional view taken along the line designated 4—4 in FIG. 3
Figure 5:
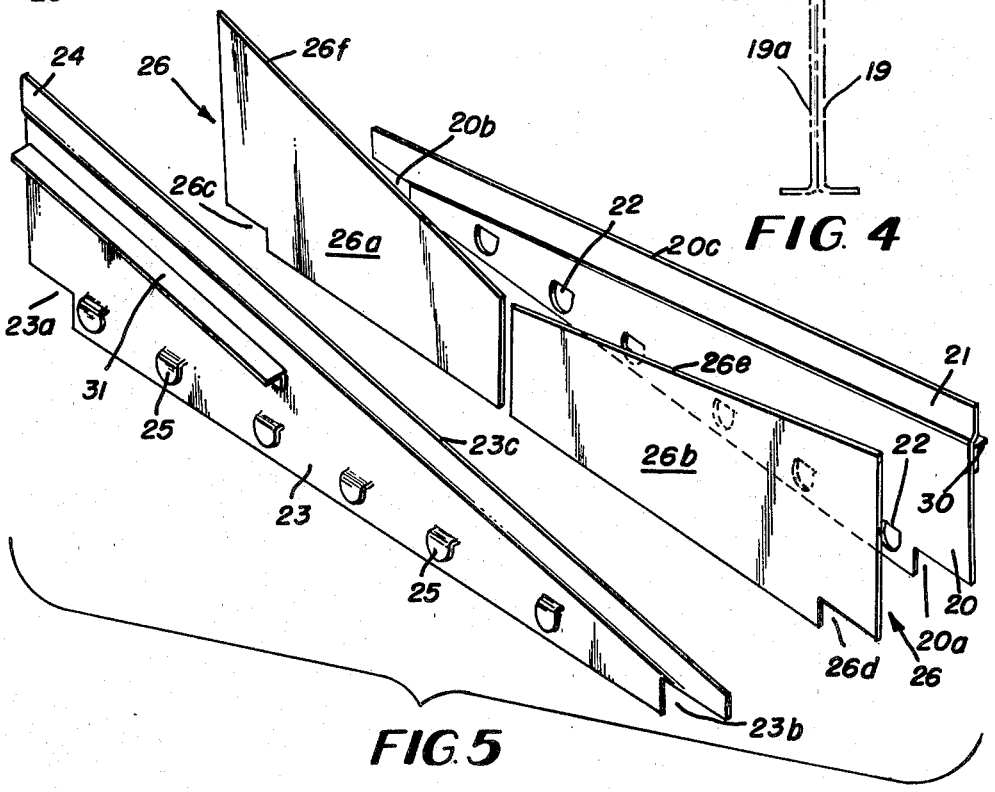
FIG. 5 is an exploded view of the structure shown in assembled form in FIG. 3.

Pitch adapter unit 16 is shown in detail in FIGS. 3, 4 and 5 and comprises a pitch adapter plate 20 which is outwardly flared along its upper edge to form a flange structure 21 and includes a plurality of detents 22 which project outwardly. The lower corners at each end of pitch adapter plate 20 are cut away as indicated at **20*a* and 20*b***.

The opposite side of the pitch adapter unit includes a second pitch adapter plate 23 which is outwardly flared along its upper edge as indicated at 24. A plurality of detents 25 are struck from pitch adapter plate 23 and project outwardly. The lower corners of pitch adapter plate 23 are cut away as indicated at **23*a* and 23*b***.

Interposed between pitch adapter plates 20 and 23 is center plate means generally designated by the numeral 26. As shown in FIG. 5 center plate means 26 comprises two parts designated **26*a* and 26*b*. It will be understood however that center plate means 26 could be formed as a single plate. Plate 26***a* is cut away at its corner as indicated at 26*c* while plate 26*b* is cut away at its corner as indicated at 26*d*.

The pitch adapter unit shown in exploded form in FIG. 5 is assembled into the condition shown in FIG. 3 by simply welding the components together in flat face contacting relation. It should be noted that the upper edge 20*c* of pitch adapter plate 20 is inclined at substantially the same angle as is the upper edge 26*e* of the center plate means 26*b*. Similarly the upper edge 23*c* of adapter plate 23 is inclined at substantially the same angle as the upper edge 26*f* of plate 26*a*.

The pitch adapter unit as shown in FIG. 3 is mounted in position as shown in FIGS. 2 and 4. The lower portion of the adapter unit as shown in FIG. 3 is inserted between the outwardly flared part 19*b* of shoe plate 19 and the outwardly flared part 19*c* of shoe plate 19*a*. Detents 25 engage the upper edge 19*d* of outwardly flared part 19*b* of shoe plate 19 while detents 22 engage the upper edge 19*e* of outwardly flared part 19*c* of shoe plate 19*a*.

With the pitch adapter unit 16 mounted as described and as shown particularly in FIG. 2, the lower part of the unit is sandwiched between the flared parts 19*b* and 19*c* of the shoe plates 19 and 19*a* and is held against end wire sliding movement because its rear end is in engagement with the post 11 and its forward end is trapped behind kick plate 27. Shoe plates 19 and 19*a* are provided at these ends with convention projecting elements which engage vertically spaced apertures 11*a* in post 11 and suitable means are provided for locking these plates in position. In like fashion known means are utilized for securing the kick plate 27 in place and the near end of pitch adapter unit 16 is thus held against movement away from corner post 11.

When base shelf 15 is moved to its down position as shown in FIG. 1, its edge flange 17 moves into the space between outwardly flared portion 21 of plate 20 and center plate 26*b* and the weight of this edge of the shelf bears against the upper edge 20*c* of plate 20. When so arranged the base shelf 15 tilts forwardly as is obvious.

For the purpose of reinforcing base shelf 15, reinforcing bars or channels 28 and 29 are secured to the bottom surface of base shelf 15. One end of bar 28 engages support bracket 30 secured to the pitch adapter plate 20 as shown and the other end of bar 28 engages bracket 30*a*. Pitch adapter unit 13 is similar to pitch adapter 16 but does not provide for the rearward tilt of the base shelf 15. Preferably the support brackets simply constitute sections of angle iron welded or otherwise secured to the adapter plates as shown in the drawings.

Assuming that the shelf 15 is of the gravity feed type, it is necessary to provide suitable arresting means in the form of a bumper bar or other suitable structure not shown in the drawings at the forward or near edge of base shelf 15 so as to stop the downward movement of items displayed on shelf 15.

If desired, the end shoe plate such as 18*a* could be covered by a suitable cover plate so as to cover the detents and the bracket 30 which form a part of the associated pitch adapter unit. Base shelf 32 associated with base 9 of gondola unit 2 is arranged with its left hand edge as viewed in FIG. 1 supported by the upper edge 23*c* of pitch adapter plate 23 as is obvious. Since the upper edge 20*c* of plate 20 is angularly disposed with respect to the upper edge 23*c* of plate 23, it is obvious that the base shelves 15 and 32 are disposed at different angles of tilt in accordance with this invention.

INDUSTRIAL APPLICABILITY

Display stands constructed and arranged according to this invention are well suited for use in supermarket outlets where space is limited and particularly where it is desired for one reason or another to display a number of products in a non-monotonous varied arrangement which is conducive to good merchandising practice.

I claim:

1. A pitch adapter unit for supporting at different angles the base shelves of adjacent display devices, said pitch adapter comprising a pair of vertically disposed pitch adapter plates having top edges which are angularly inclined, vertically disposed center plate means interposed between said pitch adapter plates and secured thereto in flat face contacting relation, the top edges of said adapter plates being inclined in opposite directions and the upper edge of said center plate means being inclined downwardly from each end thereof to a lower level between the ends thereof whereby the top edge of each end of said center plate means coincides approximately with the top edge of one end of different ones of said adapter plates.

2. A pitch adapter unit according to claim 1 wherein the inclined upper edge of each of said pitch adapter plates is spaced away from said center plate means.

3. A pitch adapter according to claim 1 wherein said center plate means comprises a pair of plates disposed in a common plane between said pitch adapter plates.

4. A pitch adapter according to claim 3 wherein each one of said pair of plates comprises an end portion of said center plate means.

5. A pitch adapter according to claim 4 wherein the upper edges of said pair of plates are inclined downwardly from the outer ends thereof respectively.

6. A pitch adapter according to claim 1 wherein a support bracket is secured to each of said pitch adapter plates on the surface thereof which is opposite from said center plate means.

7. A pitch adapter according to claim 6 wherein each of said support brackets is secured to the associated one of said pitch adapter plates near the end thereof which is of a greater vertical dimension than the opposite end thereof.

8. A pitch adapter according to claim 7 wherein each of said support brackets includes a support surface spaced downwardly somewhat and generally parallel with the adjacent top edge of the associated one of said pitch adapter plates.

9. A pitch adapter according to claim 1 wherein a plurality of outwardly projecting detents are formed on each of said pitch adapter plates for engaging display stand parts to afford support for said pitch adapter.

10. A pitch adapter according to claim 1 wherein the lower corner at each end of both of said pitch adapter plates and of said center plate means is cut away to afford clearance space for adjacent display stand parts.

* * * * *